US008192249B2

(12) United States Patent
Carter et al.

(10) Patent No.: US 8,192,249 B2
(45) Date of Patent: Jun. 5, 2012

(54) SYSTEMS AND METHODS FOR POLISHING A MAGNETIC DISK

(75) Inventors: Malika D. Carter, San Jose, CA (US); Yun-Lin Hsiao, Pleasanton, CA (US); Thomas E. Karis, Aromas, CA (US); Bruno Marchon, Palo Alto, CA (US); Ullal V. Nayak, San Jose, CA (US); Christopher Ramm, San Jose, CA (US); Wong K. Richard, San Jose, CA (US)

(73) Assignee: Hitachi Global Storage Technologies Netherlands, B.V., Amsterdam (NL)

( * ) Notice: Subject to any disclaimer, the term of this patent is extended or adjusted under 35 U.S.C. 154(b) by 592 days.

(21) Appl. No.: 12/403,273

(22) Filed: Mar. 12, 2009

(65) Prior Publication Data

US 2010/0233940 A1 Sep. 16, 2010

(51) Int. Cl.
*B24B 1/00* (2006.01)

(52) U.S. Cl. ..... 451/41; 451/168; 451/303; 451/527

(58) Field of Classification Search ..... 451/41, 451/303, 168, 527
See application file for complete search history.

(56) References Cited

U.S. PATENT DOCUMENTS

| | | | | | |
|---|---|---|---|---|---|
| 3,787,273 | A | * | 1/1974 | Okrepkie et al. | 428/56 |
| 4,412,400 | A | * | 11/1983 | Hammond | 451/163 |
| 4,656,790 | A | * | 4/1987 | Mukai et al. | 451/28 |
| 4,930,259 | A | * | 6/1990 | Kobylenski et al. | 451/303 |
| 5,209,027 | A | * | 5/1993 | Ishida et al. | 451/41 |
| 5,643,044 | A | * | 7/1997 | Lund | 451/5 |
| 5,733,181 | A | * | 3/1998 | Hasegawa et al. | 451/168 |
| 6,036,579 | A | | 3/2000 | Cook et al. | |
| 6,074,284 | A | * | 6/2000 | Tani et al. | 451/57 |
| 6,086,986 | A | * | 7/2000 | Suzuki et al. | 428/328 |

(Continued)

FOREIGN PATENT DOCUMENTS

| | | | |
|---|---|---|---|
| EP | 1 927 605 | A1 | 4/2008 |
| JP | 2000 263423 | A1 | 9/2000 |
| JP | 2001047355 | A1 | 2/2001 |
| JP | 2001067655 | A | 3/2001 |
| JP | 2001261874 | A1 | 9/2001 |
| JP | 2002124491 | A1 | 4/2002 |
| JP | 2002178255 | A1 | 6/2002 |
| JP | 2006142439 | A1 | 6/2006 |
| JP | 2006142440 | A1 | 6/2006 |
| JP | 2006339570 | A1 | 12/2006 |
| JP | 2007326984 | A1 | 12/2007 |

*Primary Examiner* — George Nguyen
(74) *Attorney, Agent, or Firm* — Duft Bornsen & Fishman, LLP

(57) ABSTRACT

A polishing system and associated methods are described for polishing a magnetic disk used in a disk drive system. The polishing system includes a polishing film that is used to polish the magnetic disk. The polishing system also includes an actuator operable to move the polishing film across a surface of the magnetic disk to polish the magnetic disk. The polishing system also includes a pad having at least one protrusion extending from a surface of the pad. The protrusion is configured to contact the polishing film and press the polishing film against the magnetic disk. The protrusion is operable to compress to about the surface of the pad when in contact with the polishing film. Once polishing is complete, the pad retracts from the polishing film and the protrusion extends from the pad, reducing the adhesion force between the pad and the polishing film.

15 Claims, 10 Drawing Sheets

U.S. PATENT DOCUMENTS 6,155,914 A * 12/2000 Reynen et al. ..... 451/168
6,193,590 B1 * 2/2001 Weiss et al. ..... 451/163
6,332,832 B1 * 12/2001 Suzuki ..... 451/41
6,402,596 B1 * 6/2002 Hakomori et al. ..... 451/44
6,592,435 B2 * 7/2003 Kishima ..... 451/59
6,648,733 B2 * 11/2003 Roberts et al. ..... 451/41
6,705,927 B2 * 3/2004 Horie et al. ..... 451/59
6,761,620 B2 * 7/2004 Naujok ..... 451/41
6,777,498 B2 * 8/2004 Imai et al. ..... 525/191
6,848,974 B2 2/2005 Hasegawa
6,884,156 B2 4/2005 Prasad
6,893,329 B2 * 5/2005 Tajima et al. ..... 451/41
6,913,517 B2 7/2005 Prasad
6,964,604 B2 * 11/2005 Chen et al. ..... 451/532
2002/0187732 A1 * 12/2002 Moore ..... 451/41
2005/0032468 A1 * 2/2005 Hunt et al. ..... 451/535
2005/0197050 A1 9/2005 Prasad et al.
2005/0287932 A1 * 12/2005 Basol et al. ..... 451/41
2006/0088735 A1 4/2006 Endou et al.

* cited by examiner

SYSTEMS AND METHODS FOR POLISHING A MAGNETIC DISK

BACKGROUND OF THE INVENTION

1. Field of the Invention

The invention is related to the field of magnetic disk polishing to remove asperities such that the data storage capabilities of magnetic disk drive systems may be increased.

2. Statement of the Problem

To keep up with the demand for increased magnetic data storage density, smoother magnetic disk surfaces are used to avoid interference with read/write heads and the magnetic disks. Generally, the magnetic layers and carbon overcoat of a thin film magnetic disk are vacuum deposited to protect the magnetic layers from corrosion. The disk is then coated with about 1 nm of lubricant and polished with a mild abrasive tape, such as an alumina composite abrasive layer on a Mylar film, to remove asperities (e.g., above 5 nm). A polishing pad is used to press the polishing tape onto a surface of the magnetic disk. For example, the polishing pad may be applied to the back of the Mylar film to ensure that the abrasive composite layer contacts the magnetic disk surface. Polishing, however, is a delicate process as it can damage a magnetic disk by scratching the 2 to 4 nm thick carbon overcoat or the magnetic layers below.

A soft elastomeric pad that has a relatively low loss tangent can improve polishing and disk yield because the pad is more apt to "track" a disk's "waviness". For example, the low modulus of the soft elastomeric pad allows the pad to more intimately contact the polishing tape when compared to the more conventional urethane foam pad, or "foam rubber" pad. The soft elastomeric pad may be injection molded from a thermoplastic elastomer (TPE), such as a block copolymer of styrene-ethylene/butylene-styrene or styrene-ethylene/propylene-styrene. However, there is a strong adhesion between the smooth Mylar tape and a smooth pad, because the lightly cross linked elastomeric pad intimately contacts the Mylar film. For example, when a soft material is pressed into contact with a flat surface, a strong adhesion force arises due to dispersion interaction energy. During the automated disk polishing process, the pad is intermittently pressed onto the back of the tape and then retracted from the tape at the end of the disk polishing process. A relatively strong adhesion between the pad and the back of the tape causes a section of the tape between guide rollers to be "pulled" with the pad when the pad is retracted. This tape deflection continues until the tape tension force exceeds the adhesion force, at which point the tape abruptly releases and snaps back to its centered position.

The tape deflection and sudden release of the tape is undesirable because the polishing tape contains an alumina particle composite binder as well as other particles that have been removed from the disk. The vibration of the tape in close proximity to the disk may therefore detach abrasive particles from the tape into the air during manufacturing potentially scratching the disks. Accordingly, there exists a need to polish magnetic disks in a manner that substantially reduces disk asperities while preventing tape deflection during the polishing process.

SUMMARY OF THE INVENTION

A polishing system and associated methods are described for polishing a magnetic disk used in a disk drive system. In one embodiment, a polishing system includes a polishing film operable to contact a surface of the magnetic disk. The polishing film includes an abrasive material operable to polish asperities from the magnetic disk. The polishing system also includes an actuator operable to move the polishing film across the surface of the magnetic disk to polish the asperities from the magnetic disk and a polishing pad configured from a thermoplastic elastomer and may contain a "slip agent". The polishing pad includes one or more protrusions extending from a surface of the polishing pad to contact the polishing film and press the polishing film against the surface of the magnetic disk. The one or more protrusions are operable to compress to about the surface of the polishing pad when pressing the polishing film against the surface of the magnetic disk. The one or more protrusions may be operable to extend from the surface of the polishing pad when the polishing pad is removed from contact with the polishing film. For example, the one or more protrusions may extend from the surface of the polishing pad at least about 100 microns. In this regard, the polishing pad may have an adhesion force with the polishing film of less than about 100 milligrams. Generally, an adhesion force as used herein refers to the mass times gravity value required to break the bond between the polishing tape and the polishing pad when the polishing pad is withdrawn from polishing tape. The system may also include a mounting bracket operable to retain the one or more protrusions of the polishing pad in a compressed position during polishing.

In another embodiment, a system is operable to polish a magnetic disk and includes a polishing film operable to contact a surface of the magnetic disk. The polishing film includes an abrasive material operable to polish the magnetic disk and an actuator operable to move the polishing film across the surface of the magnetic disk to polish the magnetic disk. The system also includes a polishing pad that comprises at least one protrusion extending from a surface of the polishing pad to contact the polishing film and press the polishing film against the magnetic disk. The protrusion is operable to compress to about the surface of the polishing pad when in contact with the polishing film.

In another embodiment, a method of polishing a magnetic disk includes retaining the magnetic disk with a mount, positioning a polishing tape proximate to the magnetic disk. The polishing tape includes an abrasive material operable to polish asperities from a surface of the magnetic disk. The method also includes positioning a polishing pad proximate to the polishing tape. The polishing pad includes one or more protrusions extending from a surface of the polishing pad. The method also includes pressing the polishing tape against a surface of the magnetic disk via the one or more protrusions of the polishing pad and moving the polishing tape about the surface of the magnetic disk to polish the magnetic disk.

DESCRIPTION OF THE DRAWINGS

The same reference number represents the same element or same type of element on all drawings.

The invention may include other exemplary embodiments described below.

DETAILED DESCRIPTION OF THE INVENTION

FIGS. 1-16 and the following description depict specific exemplary embodiments of the invention to invention to teach those skilled in the art how to make and use the invention. For the purpose of teaching inventive principles, some conventional aspects of the invention have been simplified or omitted. Those skilled in the art will appreciate variations from these embodiments that fall within the scope of the invention. Those skilled in the art will also appreciate that the features described below can be combined in various ways to form multiple variations of the invention. As a result, the invention is not limited to the specific embodiments described below, but only by the claims and their equivalents.

Figure 1:
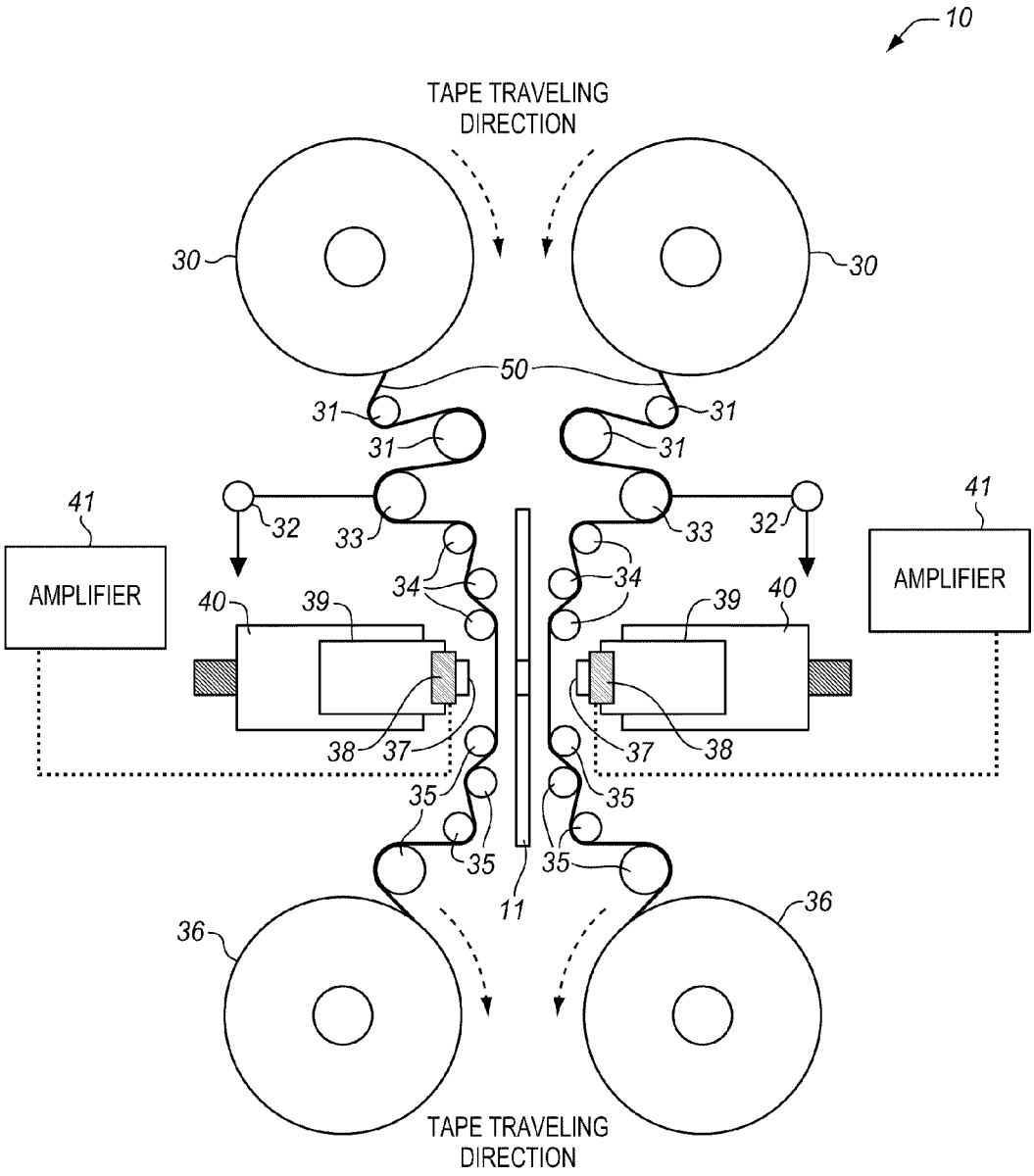
FIG. 1 is a block diagram of a polishing system in one exemplary embodiment of the invention.

FIG. 1 illustrates a system 10 used in removing asperities from a magnetic disk 11. The system 10 includes a pair of mechanisms for polishing both sides of a magnetic disk 11. Each of the mechanisms includes a reel 30, guide rollers 31, a tensioning mechanism 32, guide rollers 34, a pressure mechanism including an elastic polishing pad 37, and a take-up roller 36. The reel 30 feeds a polishing tape 50 wound around the reel. The guide rollers 31 guide the polishing tape 50 fed from the reel 30. The tensioning mechanism 32 uses an air cylinder to apply tension to the polishing tape 50 fed between the guide rollers 31 and a guide roller 33. The guide rollers 34 guide the polishing tape 50, to which the tension is applied, onto a surface of the magnetic disk 11. The pressure mechanism including the polishing pad 37 lets the polishing tape 50 slide over the surface of the magnetic disk 11 with a predetermined pressure by pressing the polishing tape 50 onto the surface of the magnetic disk 11 using the polishing pad 37. The take-up roller 36 takes up the polishing tape 50 that has undergone the polishing process via guide rollers 35.

The system 10 applies pressure to the polishing tapes 50 such that the tapes 50 are brought into contact with the corresponding surfaces of the magnetic disk 11, which is kept rotating. The system 10 thus removes asperities from both sides of the magnetic disk 11 at the same time. For example, when the polishing tape 50 contacts the magnetic disk 11 and the desired pressure is reached, the polishing tape 50 is moved radially from an inner periphery to an outer periphery of the magnetic disk 11. Thus, the entire recording surfaces of the magnetic disk 11 are polished.

The contact pressure of the polishing tape 50 on the magnetic disk 11 surface is controlled by the pressure mechanism that presses the polishing pad 37 against the disk surface at the desired pressure. A base portion, on which the polishing pad 37 is mounted, serves as a strain gage sensor 38. The pressure control is a feedback system. For example, when the polishing pad 37 contacts the magnetic disk 11 via the polishing tape 50, a stress strain is produced in the strain gage sensor 38. A strain output caused by the stress strain is given as a voltage signal to an amplifier 41. The voltage signal is then converted to a corresponding pressure value. A command is then issued to a servomotor so as to maintain the desired pressure. The servomotor may then drive a pressure base portion 40 by way of a ball screw.

To stabilize the pressing force, the strain gage sensor 38 is mounted on a slide mechanism 39 with a low coefficient of friction. At the completion of the polishing sequence, that is, when the tape has left the disk surface on the outer periphery thereof, the polishing tape 50 is fed a distance equivalent to or more than the length of the pad in a longitudinal direction of the tape for each disk.

Figure 2:
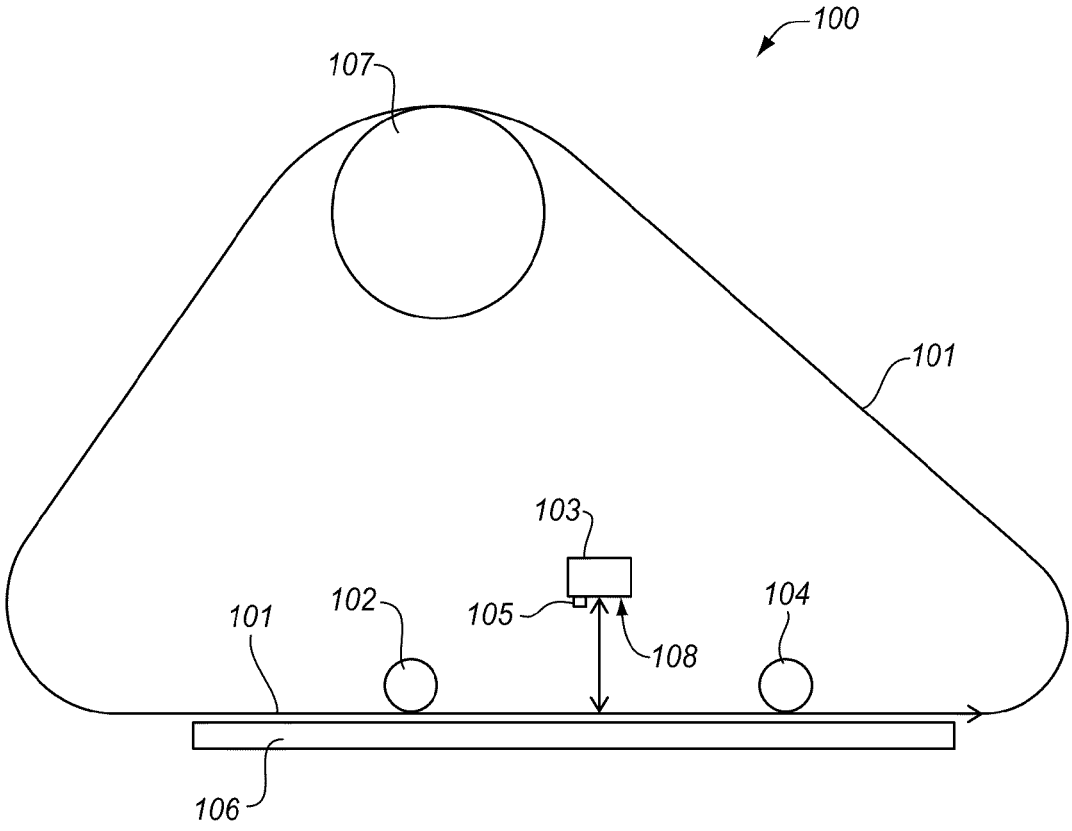
FIG. 2 is a block diagram of another polishing system in one exemplary embodiment of the invention.

FIG. 2 is a block diagram of a polishing system 100 in one exemplary embodiment of the invention. In this embodiment, the polishing system 100 is used to polish a magnetic disk 106 used in a disk drive. Generally, the polishing system 100 is used to burnish relatively small asperities on a surface of the magnetic disk 106. For example, the polishing system 100 may be used to remove asperities above about 5 nm. To do so, the polishing system 100 may apply a polishing film 101 against a surface of the magnetic disk 106. This polishing film 101 may exist in the form of a biaxially-oriented polyethylene terephthalate polishing tape, such as Mylar.

The polishing film 101 includes a mild abrasive that is used to remove these asperities by carefully moving the film across the surface of the magnetic disk 106. The polishing system 101 may be configured with a mechanism that actuates motion of the tape along the surface of the magnetic disk 106. For example, the polishing system 102 may include rollers 102 and 104 mechanically coupled to an actuator 107 that pulls the polishing film 101 across the rollers 102 and 104. The magnetic disk 106 is positioned proximate to the rollers 102 and 104 such that the polishing film 101 may be applied to the magnetic disk 106.

The polishing film 101 is applied to the magnetic disk 106 by way of a polishing pad 103 that presses the polishing film 101 against the surface of the magnetic disk 106. For example, the polishing pad 103 may apply a certain amount of pressure against the back of the polishing film 101 that forces the polishing film 101 against the surface of the magnetic disk 106. The polishing film 101 is then moved via the actuator 107 along the rollers 102 against the magnetic disk 106. The combination of the pressure from the polishing pad 103 and the abrasive material of the polishing film 101 serves to polish the asperities from the surface of the magnetic disk 106.

As previously mentioned, the polishing process is delicate. A foam pad with a higher lost tangent was used to polish magnetic disks in the past. The pressure that is applied by the pad 103 is substantial enough to reduce the asperities in the magnetic disk 106 yet gentle enough to prevent scratching of the surface of the magnetic disk 106. Previous techniques included the use of a smooth thermoplastic elastomer pad that was pressed against the back of the polishing film 101. The smooth pad was effective at removing the asperities. However, the smooth pad would adhere to the back of the polishing film 101 at the end of the polishing process when the pad was retracted from the polishing film. This adhesion of the pad 103 to the polishing film 101 could be as high as 5 g and tended to pull the polishing film 101 away from the surface of the magnetic disk 106 causing the polishing film 101 to snap back when the tension in the film became larger than the adhesion force between the polishing film and the pad. In some cases, this tape deflection could be as high as 650 μm. Again, this "snapping back" of the polishing film 101 released abrasive particles from the polishing film as well as burnished particles from the magnetic disk 106. These loose particles can damage the surface of the magnetic disk 106. For example, when polishing a magnetic disk for use in a disk drive, the magnetic disk is polished in a clean room environment so as to prevent loose particles from scratching the processed disk. A scratched disk may interfere with a read/write head making the disk inoperable.

The polishing system 100 overcomes the previous deficiencies by providing a pad 103 that includes one or more protrusions 105 extending from a surface 108 of the pad 103. These protrusions 105 reduce the adhesion force between the pad 103 and the polishing film 101. In one embodiment, the pad 103 reduces the adhesion force to below about 20 mg causing a taped deflection of only about 50 μm, thereby reducing the tape deflection by as much as 600 μm.

To achieve this substantial reduction in the adhesion force between the pad 103 and the polishing film 101, the pad and the protrusions 105 thereof may be configured from a relatively soft elastomeric polymer having a Shore A hardness in a range of about 1 to 10. For example, the pad 103 may be an injected molded TPE such as Kraton, Dynaflex, and Versaflex produced by GLS Corporation of McHenry, Ill. Such a material may provide a certain level of compression that is used to assist in the release of the protrusion from the polishing film 101 as illustrated in FIGS. 3A and 3B.

Figure 3A:
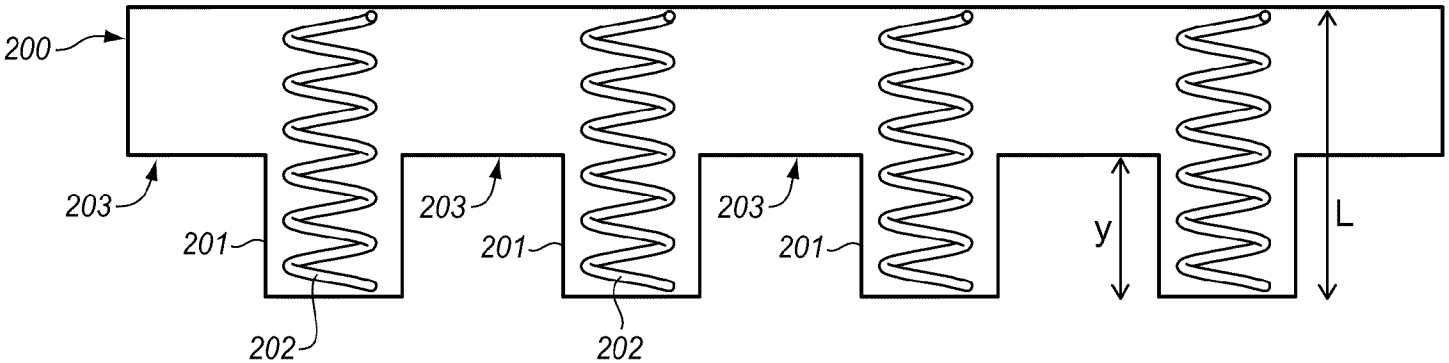
FIGS. 3A and 3B illustrate a side view of a polishing pad used in the polishing system in one exemplary embodiment of the invention.
Figure 3B:
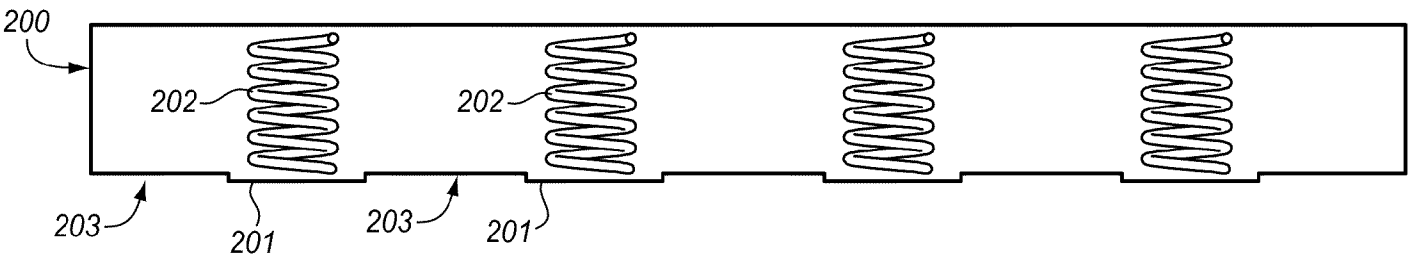

FIGS. 3A and 3B illustrate a side view of a polishing pad 200 that may be used in the polishing system 100 in one exemplary embodiment of the invention. In this embodiment, the pad 200 is illustrated in released and compressed states in FIGS. 3A and 3B, respectively. The released state shows multiple protrusions 201 extending from a surface 203 of the pad 200. The springs 202 within the pad 200 are merely intended to illustrate a certain level of resilience that the protrusions 201 may have. For example, the pad 200 may be configured from material having a certain level of elasticity that allows for the protrusions 201 to be compressed, as shown with the springs 202 in FIG. 3B, when the pad 200 is pressed against the back of the polishing film 101 during polishing. When the pad 200 is retracted from the polishing film 101, the protrusions 201 retain their original shapes and again extend from the surface 203 of the pad 200.

These protrusions 201, as they extend from the surface 203 when the pad 200 is retracted from the polishing film 101, reduce the adhesion force between the pad 200 and polishing film 101. As mentioned, an adhesion force generally arises from dispersive adhesion stress, or force per unit area, between the pad 200 and the polishing film 101. The total adhesion force may be decreased if the surface area of the pad 200 in contact with the polishing film 101 is decreased when the pad 200 is retracted from the film 101.

Figure 4:
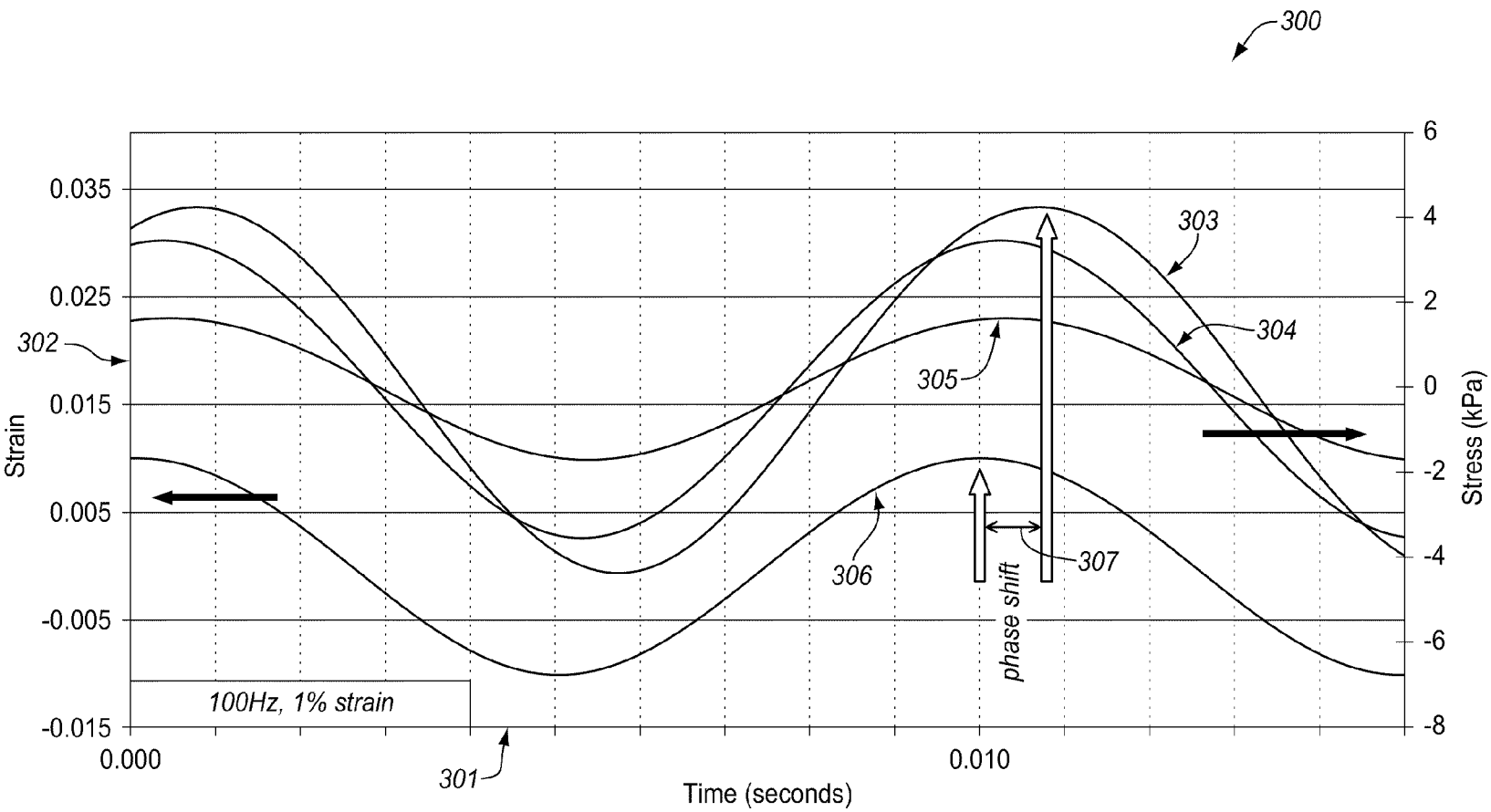
FIG. 4 is a graph illustrating the tracking of the polishing pad on an uneven surface of a magnetic disk.

Also, the pad 200 applies a relatively uniform pressure against the film 101 to maintain an even polishing of the magnetic disk 106 and, in this regard, "track" the "waviness" of the magnetic disk 106. For example, the magnetic disk 106 is typically not perfectly smooth upon fabrication. The surface topography of the pad 200, therefore, should not be dramatically altered so as to maintain intimate contact with the magnetic disk 106 during polishing. The pad 200, configured from one or more of the materials above, compensates for this waviness of the magnetic disk 106 by remaining in intimate contact with the magnetic disk (i.e. via the polishing film 101) to ensure that the magnetic disk 106 is well polished. FIG. 4 is a graph 300 illustrating the tracking of various polishing pads on an uneven surface of a magnetic disk. The graph 300 is illustrated with time on the axis 301 and strain on the axis 302. A traditional polishing pad configured of foam rubber is illustrated via the plot 303. A soft pad in one exemplary embodiment of the invention is illustrated via the plot 305 and another "blended" soft pad in one exemplary embodiment of the invention is illustrated via the plot 304. The soft pad is injection molded from Dynaflex G6703 and the blended soft pad is injection molded from Dynaflex G6703 with 50% Dynaflex G6713. Both contain about 0.2% Armoslip E slip agent, produced by AKZO Nobel Polymer Chemicals, LLC of Chicago, Ill. Both the soft pad and the blended soft pad are more capable of tracking the waviness of the magnetic disk 106 because these pads have a lower loss tangent as demonstrated under an oscillatory compression against the magnetic disk 106. The traditional foam rubber pad of the plot 303, however, experiences a higher loss tangent which results in a phase shift 307, implying that the traditional foam rubber pad is less apt to track the waviness of the magnetic disk 106. While the relatively soft material of the pad 200 allows the pad to make a more intimate contact, the protrusions 201 assist in overcoming the adhesion force by "springing out" to release the adhesion force on the regions of the surface 203 between the protrusions 201.

Figure 5:
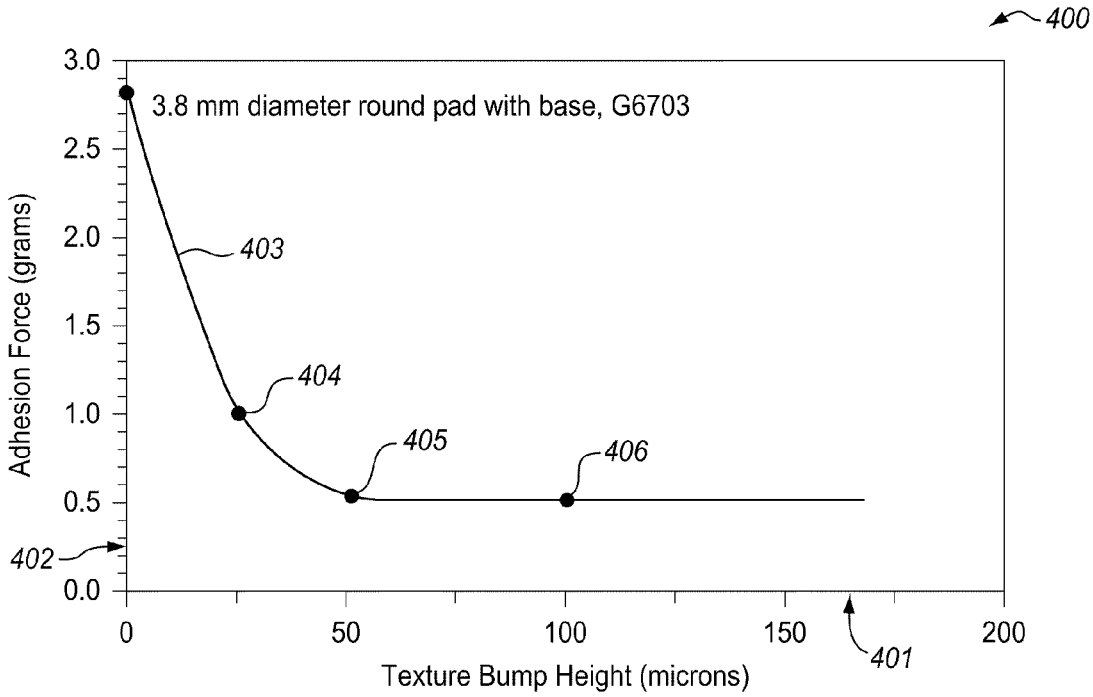
FIG. 5 is a graph illustrating adhesion force of a polishing pad with respect to protrusion height in one exemplary embodiment of the invention.
Figure 6:
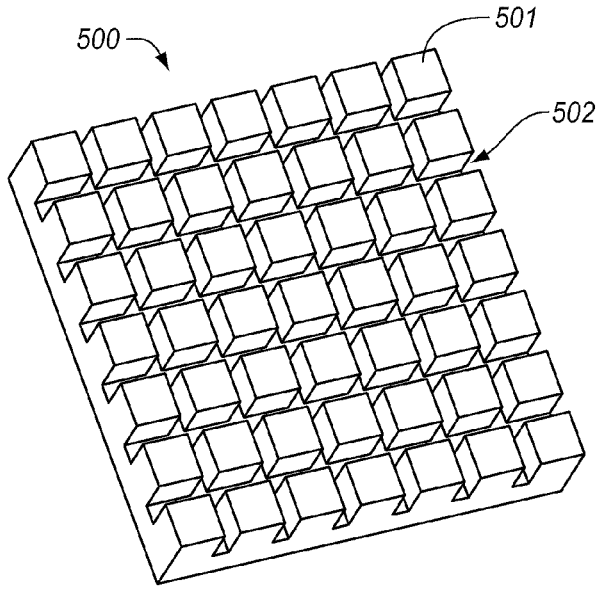
FIGS. 6-9 are graphs illustrating pads with varying protrusion heights, sizes, and separations exemplary embodiments of the invention.
Figure 7:
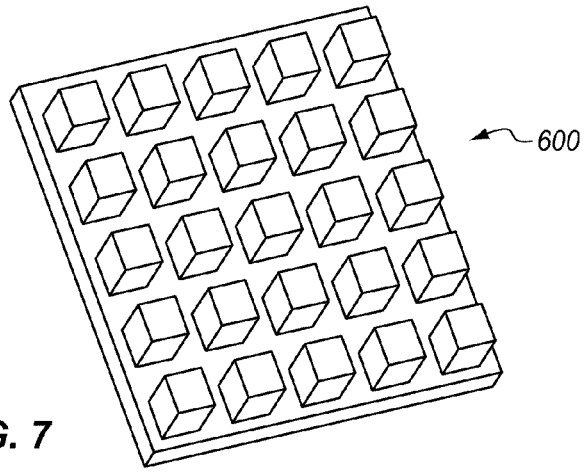
Figure 8:
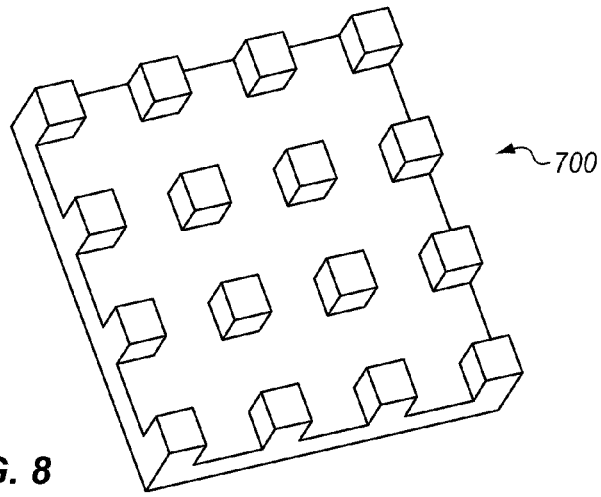
Figure 9:
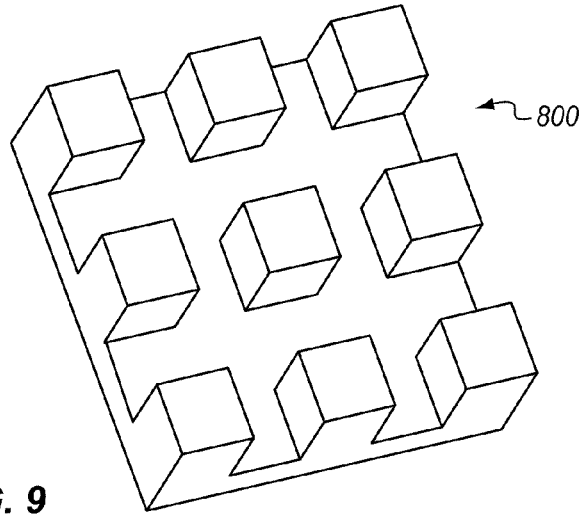

The protrusions 201 may be configured of a height y with an effective spring length l. The compressive strain i-s then y/l and the spring recovery stress is therefore (y/l)E, where E is Young's modulus of the pad material, for example 23 kPa. The adhesion stress of the surface 203 of the pad 200 surrounding the protrusions 201 is σ, which is about 2.4 kPa measured on a smooth pad surface. Thus, the equation for the protrusions 201 to release the surrounding flat area from the polishing film 101 is $(y/l)E>(1-f)\sigma$, where f is the surface area fraction formed by the protrusions. The effective spring length of the protrusions can then be calculated as $l=yE/((1-f)\sigma)$. The adhesion force for protrusions 201 configured in square shapes of about 100 μm by 100 μm and spaced about 50 μm apart was empirically determined to be about 500 mg as shown in FIG. 5. Based on this determination, the effective spring length l is about 860 μm, meaning that the protrusion height should be at least 100 μm, preferably greater.

Generally, it is desirable to reduce the adhesion force below about 400 mg. This may be achieved by decreasing the surface area on top of the protrusions 201 and configuring the protrusions farther apart, keeping in mind that the protrusion height y should be greater than $l(1-f)\sigma/E$. Various pad configurations 500-800 of such are shown in FIGS. 6-9. For example, the pad 500 is illustrated with square surface protrusions 201 having a spacing 502. The remaining pad configurations 600 to 800 illustrate other various heights, spacings, and surface areas for the protrusions 201.

Using Dynaflex G6703 injection molded with about 0.2% Armoslip E, the protrusion height y may be about 100 μm. The adhesion force, in this regard, generally scales with the residual surface area fractions $f=x^2/(x+w)^2$ of the protrusions 201, where x is the protrusion length and w is the width of the space between the protrusions in a uniform grid pattern. An example of this adhesion force scaling is illustrated in FIG. 10.

Figure 10:
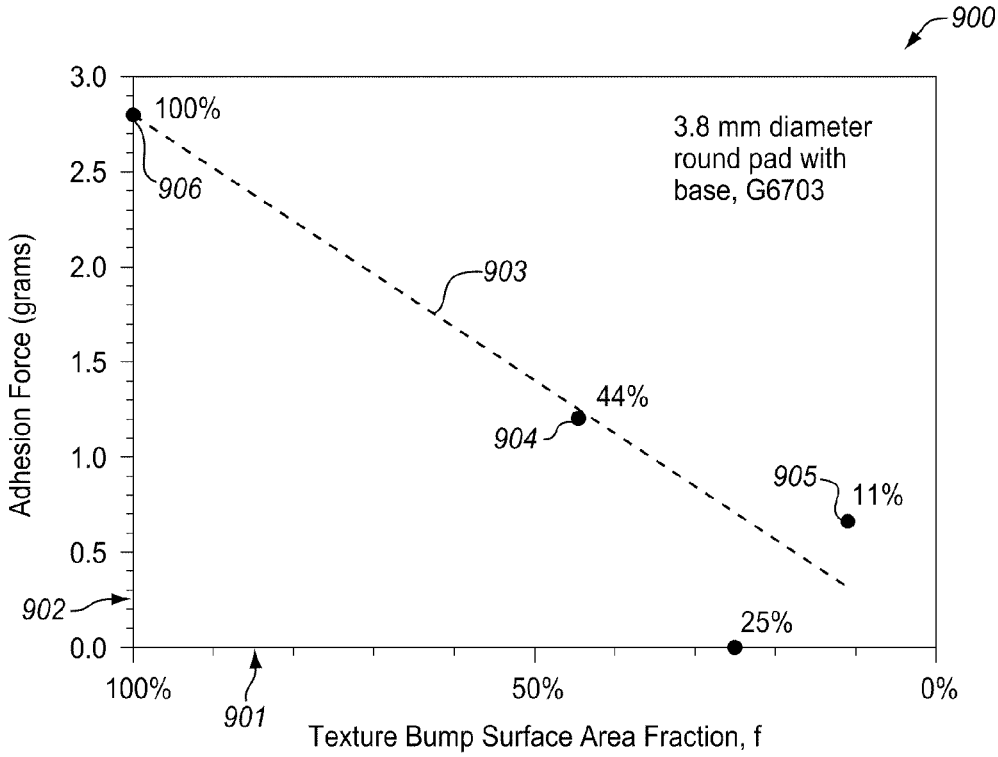
FIG. 10 is a graph illustrating adhesion force of a polishing pad with respect to fractional surface area of protrusions in one exemplary embodiment of the invention.

FIG. 10 is a graph 900 illustrating actual experimental results for adhesion force of a polishing pad (e.g., the pad 200) with respect to the fractional surface area of the protrusions (e.g., the protrusions 201) in one exemplary embodiment of the invention. In this embodiment, various pad configurations were implemented, each of which being Dynaflex G6703 injection molded with about 0.2% Armoslip E. The graph 900 shows that the adhesion force scales almost linearly along line 903 according to the fractional surface area of the protrusions. A smooth pad configured without protrusions yielded an adhesion force of roughly 2.8 g, causing a tape deflection of about 650 μm. When the protrusions are configured in the pad, the adhesion force drops significantly as illustrated in the table below:

| Width, x, in μm | Spacing, w, in μm | Height, y, in μm | Surface Area Fraction, f | Measured Adhesion Force in grams | Tape Deflection in μm | Location on Graph 900 |
|---|---|---|---|---|---|---|
| 0 | 0 | 0 | 100% | 2.8 | 650 | Point 906 |
| 100 | 50 | 100 | 44% | 1.2 | 320 | Point 904 |
| 100 | 100 | 100 | 25% | 0.018 | 50 | Point 906 |
| 100 | 200 | 100 | 11% | 0.67 | 180 | Point 905 |
| 200 | 200 | 200 | 25% | 0.017 | 50 | Point 906 |

Although shown and described for the most part with respect to square protrusions, the invention is not intended to be so limited. Rather, other surface area shapes, such as rectangles, triangles, and circles, may be implemented for the protrusions. In fact, a reduced surface area fraction for the protrusions generally reduces the adhesion force. Accordingly, pyramidal and conical shapes extending from the surface of the pad may improve the adhesion force reduction. Moreover, a "rounding" of the square profile design of the protrusions may occur during the injection molding process. The rounding deformation is probably caused by partial recovery of a polymer chain deformation that is "frozen-in" when the molten polymer cools while flowing into the protrusion cavities of a mold.

FIGS. 11-15 illustrate mounts used to retain various polishing pads in exemplary embodiments of the invention. As mentioned, the polishing pads may take a variety of shapes that relieve the adhesion force when configured with a TPE. To ensure that the TPE pad applies a uniform pressure against the back of the polishing film 101, the pad is configured within a mount that rigidly retains the pad. Previously, TPE has been difficult to secure making a TPE pad apply nonuniform pressure during the polishing process. The mounts and the TPE pads herein alleviate such difficulties making the TPE pad a better polishing pad than the traditional foam rubber polishing pads.

Figure 11:
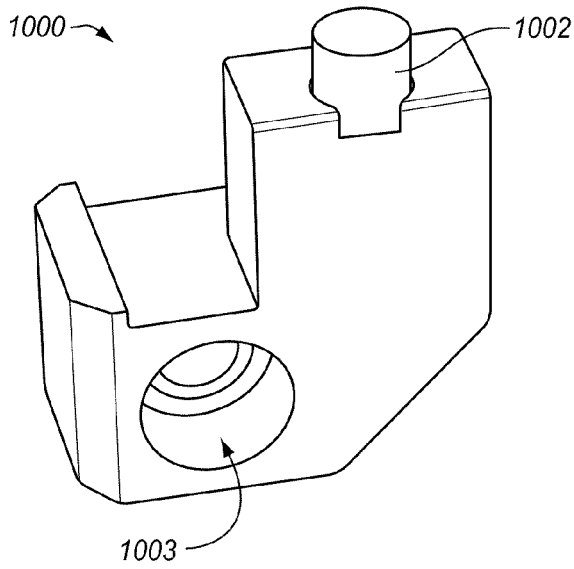
FIGS. 11-15 illustrate mounts used to retain various polishing pads in exemplary embodiments of the invention.
Figure 12:
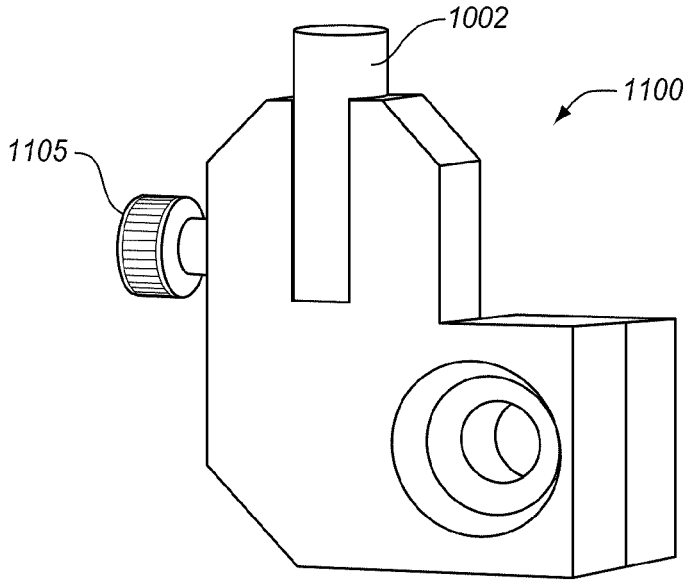
Figure 13:
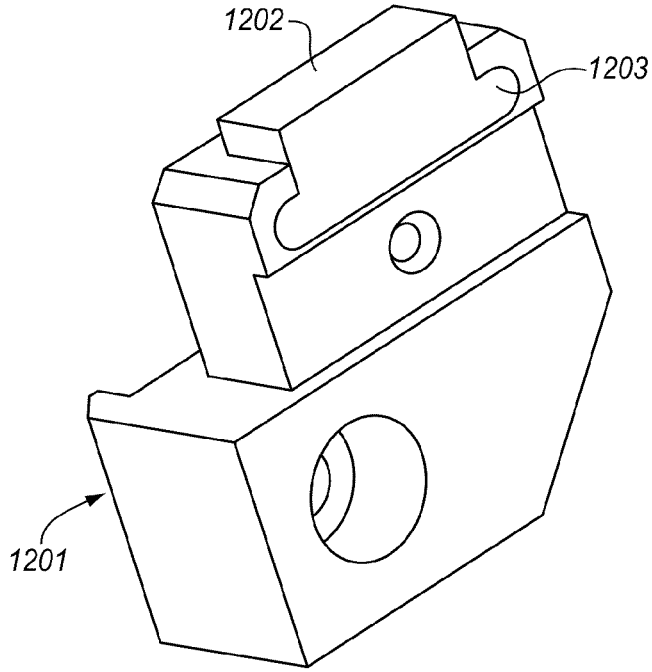
Figure 14:
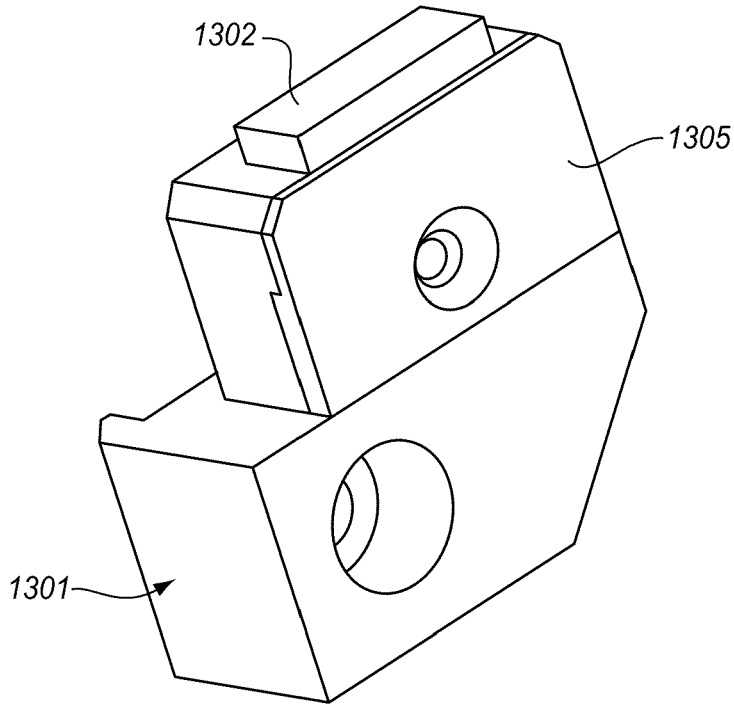
Figure 15:
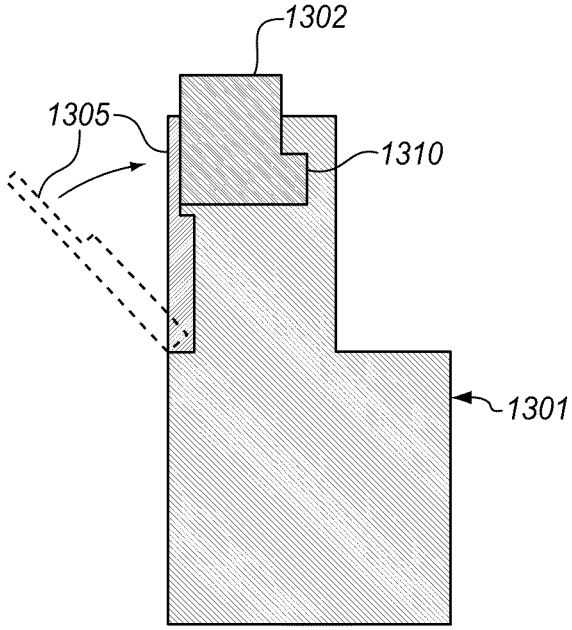

In FIGS. 11 and 12, a cylindrical TPE pad 1002 is retained within the mount 1000. FIG. 11 illustrates the TPE pad 1002 residing within a similarly shaped retaining section within the mount 1000. The TPE pad 1002 may be retained within the mount 1000 using an adhesive, but the adhesive bond to such materials may be unreliable. However, it is the rigid support of the mount 1000 that ensures that the TPE pad 1002 applies a uniform pressure when secured to an actuator via the coupling mechanism 1003. FIG. 12 illustrates a similar embodiment where the TPE pad 1002 is instead retained with a locking bolt 1105. Compressing a pad cylinder with a locking bolt may cause an unacceptable variation in the pad height. FIGS. 13 through 15 illustrate rectangular shaped pads 1202 and 1302 and their respective mechanisms for retaining the pads. For example, the rectangular pad 1202 is configured with tabs 1203 that are retained within a similarly shaped section of the mount 1201. FIGS. 14 and 15 illustrate another embodiment where the rectangular pad 1302 is configured with a tab 1310 that resides within the mount 1301. A "door" 1305 allows for the pad 1302 to slide into a cavity in the mount 1301. The door 1305 then closes and provides a rigid support for the pad 1302 to ensure that the pad applies a uniform pressure against the back of the polishing film 101 and remains precisely located within the cavity of the holder.

Figure 16:
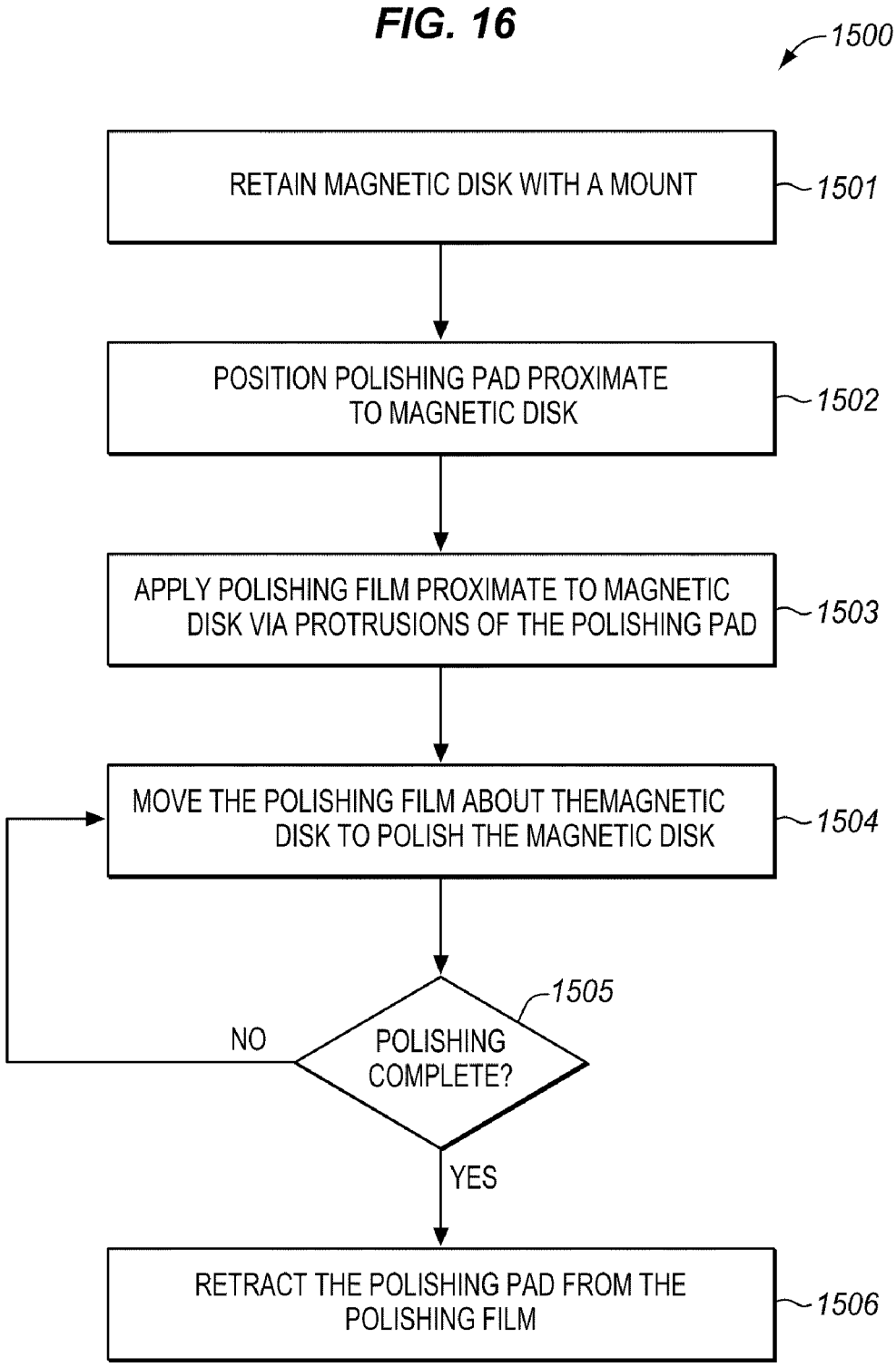
FIG. 16 is a flowchart of a process for polishing a magnetic disk in one exemplary embodiment of the invention.

FIG. 16 is a flowchart of a process 1500 for polishing a magnetic disk 106 in one exemplary embodiment of the invention. The process 1500 may be implemented so as to burnish a magnetic disk used in a disk drive system such that the storage capacity of the disk drive system may be increased. The process 1500 initiates when the magnetic disk 106 is retained within a mount in the process element 1501. The polishing system 100 then positions the polishing pad 103 proximate to the magnetic disk 106 in the process element 1502. The polishing system 100 then applies a polishing film 101 to the magnetic disk 106 via the polishing pad 103 in the process element 1503. For example, the polishing system 100 may apply pressure to the back of the polishing film 101 via the polishing pad 103 such that the polishing film 101 makes intimate contact with the magnetic disk 106. The polishing pad 103 includes one or more protrusions that are designed to compress to about the surface of the polishing pad as shown and described in FIGS. 2A and 2B. The polishing film 101 may be configured as a Mylar tape having an abrasive material that is used to polish the magnetic disk 106 when the film is applied to the magnetic disk 106 via the polishing pad 103 and moved about. The actuator 107, in this regard, moves the polishing film 101 about the surface of the magnetic disk 106 in the process element 1504.

The polishing process concludes after a certain number of passes required to remove the asperities from the magnetic disk 106 (e.g., process element 1505). When completed, the polishing system 100 retracts the polishing pad 103 from the polishing film 101 in the process element 1506. The protrusions extending from the polishing pad 103 reduce a surface area adhesion between the pad 103 and the polishing film 101. For example, when the polishing system 100 removes pressure from the pad 103 against the polishing film 101, the protrusions tend to spring out from a surface of the pad 103 and essentially break the adhesion force between the polishing film 101 and the pad 103. As mentioned above, the protrusions may be configured in a variety of shapes and spacings to reduce the adhesion force and thus the deflection of the polishing film 101. This reduced deflection assists in preventing dispersion of particles that may potentially damage the magnetic disk 106.

Although specific embodiments were described herein, the scope of the invention is not limited to those specific embodiments. The scope of the invention is defined by the following claims and any equivalents thereof.

We claim:

1. A system operable to polish a magnetic disk, the system comprising:

a polishing film operable to contact a surface of the magnetic disk, wherein the polishing film comprises an abrasive material operable to polish the magnetic disk;

an actuator operable to move the polishing film across the surface of the magnetic disk to polish the magnetic disk; and a polishing pad that comprises at least one protrusion extending from a surface of the polishing pad to contact the polishing film and press the polishing film against the magnetic disk, wherein the at least one protrusion is operable to compress to about the surface of the polishing pad when in contact with the polishing film, wherein the polishing pad is configured from a thermoplastic elastomer with a slip agent additive.

2. The system of claim 1, wherein the at least one protrusion is operable to extend from the surface of the polishing pad when the polishing pad is removed from contact with the polishing film.

3. The system of claim 1, wherein the at least one protrusion extends from the surface of the polishing pad at least about 100 microns.

4. The system of claim 1, wherein the polishing pad has an adhesion force with the polishing film of less than about 100 milligrams.

5. The method of claim 1, further comprising a mounting bracket operable to retain the at least one protrusion of the polishing pad in a compressed position during polishing.

6. A method of polishing a magnetic disk, the method comprising:

retaining the magnetic disk with a mount;

positioning a polishing tape proximate to the magnetic disk, wherein the polishing tape comprises an abrasive material operable to polish asperities from a surface of the magnetic disk;

positioning a polishing pad proximate to the polishing tape, wherein the polishing pad comprises one or more protrusions extending from a surface of the polishing pad;

pressing the polishing tape against a surface of the magnetic disk via the one or more protrusions of the polishing pad; and moving the polishing tape about the surface of the magnetic disk to polish the magnetic disk; and releasing force of the polishing pad against the polishing tape after polishing, wherein releasing force causes the one or more protrusions to extend from the surface of the polishing pad, wherein the one or more protrusions have an adhesion force of less than about 100 milligrams when the force is released.

7. The method of claim 6, wherein positioning the polishing pad comprises compressing the one or more protrusions against a surface of the polishing tape by at least 100 microns.

8. The method of claim 6, wherein pressing the polishing tape against the surface of the magnetic disk comprises applying force to the polishing tape via the one or more protrusions of the polishing pad.

9. The method of claim 6, wherein positioning the polishing pad proximate to the polishing tape comprises configuring the polishing pad with a mounting bracket operable to retain the one or more protrusions of the polishing pad in a compressed position during polishing.

10. A system operable to polish a magnetic disk, the system comprising:

a polishing film operable to contact a surface of the magnetic disk, wherein the polishing film includes an abrasive material operable to polish asperities from the magnetic disk;

an actuator operable to move the polishing film across the surface of the magnetic disk to polish the asperities from the magnetic disk; and a polishing pad configured from a thermoplastic elastomer and a slip agent additive, wherein the polishing pad comprises one or more protrusions extending from a surface of the polishing pad to contact the polishing film and press the polishing film against the surface of the magnetic disk, wherein the one or more protrusions are operable to compress to about the surface of the polishing pad when pressing the polishing file against the polishing the surface of the magnetic disk.

11. The system of claim 10, wherein the one or more protrusions are operable to extend from the surface of the polishing pad when the polishing pad is removed from contact with the polishing film.

12. The system of claim 10, wherein the one or more protrusions extend from the surface of the polishing pad at least about 100 microns.

13. The system of claim 10, wherein the polishing pad has an adhesion force with the polishing film of less than about 100 milligrams.

14. The system of claim 10, further comprising a mounting bracket operable to retain the one or more protrusions of the polishing pad in a compressed position during polishing.

15. The system of claim 10, wherein the polishing pad is configured via an injection mold of the thermoplastic elastomer with the slip agent additive.

* * * * *

UNITED STATES PATENT AND TRADEMARK OFFICE

CERTIFICATE OF CORRECTION

PATENT NO. : 8,192,249 B2
APPLICATION NO. : 12/403273
DATED : June 5, 2012
INVENTOR(S) : Carter et al.

It is certified that error appears in the above-identified patent and that said Letters Patent is hereby corrected as shown below:

Title Page, Item 75

Please change inventor's name from "Wong K. Richard" to --Richard K. Wong--

Signed and Sealed this
Twentieth Day of November, 2012

David J. Kappos

David J. Kappos
*Director of the United States Patent and Trademark Office*